United States Patent [19]

Helfman

[11] Patent Number: 4,559,738

[45] Date of Patent: Dec. 24, 1985

[54] TOP SIDER PLANTER

[76] Inventor: Barbara Helfman, 2312 Central Ave., Middletown, Ohio 45042

[21] Appl. No.: 598,367

[22] Filed: Apr. 9, 1984

[51] Int. Cl.[4] ..... A01G 9/02

[52] U.S. Cl. ..... 47/66; 47/68

[58] Field of Search ..... 47/66, 68, 39; 248/208, 248/214, 311.2

[56] References Cited

U.S. PATENT DOCUMENTS

| | | | |
|---|---|---|---|
| D. 257,993 | 1/1981 | DeMars . | |
| 1,353,853 | 9/1920 | Sandberg | 47/68 |
| 1,852,650 | 4/1932 | Halberstadter | 248/208 |
| 1,955,476 | 4/1934 | Torgersen | 47/68 |
| 2,896,893 | 7/1959 | Oliver | 248/208 |
| 2,971,805 | 4/1976 | Weiss . | |
| 3,027,014 | 3/1962 | Lindblom . | |
| 3,664,626 | 5/1972 | Sneller | 248/214 |
| 4,015,543 | 4/1977 | Stankowitz . | |
| 4,062,147 | 12/1977 | Phillips | 47/66 |
| 4,137,668 | 2/1979 | Kojo | 47/71 |
| 4,315,382 | 2/1982 | Kay et al. | 47/66 |
| 4,415,091 | 11/1983 | Wolff . | |

*Primary Examiner*—Robert A. Hafer
*Assistant Examiner*—Bradley M. Lewis
*Attorney, Agent, or Firm*—Frost & Jacobs

[57] ABSTRACT

A planter is designed to be positioned on top of or against an office partition wall. The planter may include brackets which support the planter on top of the partition wall, or against the partition wall. The planter may also be self-supporting by forming a groove in the bottom of the planter, the groove being designed to snugly fit over the top of the wall, or the planter may include an integral horizontal arm with a downwardly projecting component or another planter, wherein the wall friction fits between the dual planters or between the planter and the downwardly projecting component.

12 Claims, 24 Drawing Figures

TOP SIDER PLANTER

BACKGROUND OF THE INVENTION

1. Field of the Invention

The present invention relates to containers for plants and other decorative objects. In particular, the present invention relates to containers capable of being mounted upon or supported by wall partitions such as those frequently employed in offices.

2. Prior Art

With the advent of modern office wall partitions, individual offices or work stations became more compact to utilize all available floor space. Because each work station is generally designed to accommodate a desk, chair, and filing cabinet, very little open floor space remained available within each work station. Accordingly, there is very little room in work stations for personal plants. Most plants in modern offices are positioned in hall corners, but are too few in number to give a warm, friendly, personal atmosphere to the working environment.

U.S. Pat. No. 4,015,543 to Stankowitz discloses a support bracket designed to be mounted between and supported by wall partitions. The support bracket is perpendicular to the wall partitions and receives an octagonal saucer, upon which plants and other decorative objects can be placed. These objects project a substantial distance from the partition walls, and if employed in work stations, would merely serve to make crowded conditions worse. Moreover, the support bracket is incapable of supporting anything except the lightest of objects, such that heavy plants could not be placed upon the saucer.

U.S. Pat. No. 4,415,091 to Wolff discloses a plurality of wall partitions joined together at their vertical edges. A beam member is supported at each of its end edges with a hanger which is inserted between the wall partitions where they join together. Various types of racks are designed to be securely suspended from one or more beams, yielding an unlimited number of combinations of racks for any purpose desired. The racks project a substantial distance from the partition walls, and if employed in work stations, would serve to make crowded conditions worse.

Because the prior art partition wall plant supports substantially project into the work station, a need exists for a plant arrangement capable of providing each work station with plants, yet maximizing the space within the work station.

SUMMARY OF THE INVENTION

The present invention concerns mounting a planter upon a partition wall in such a manner that it projects into the work station only a slight distance compared to prior art devices. Specifically, the present invention mounts a planter on top of a partition wall or against a partition wall such that the planter slightly projects into a work station.

In the broadest sense the invention includes a planter adapted to be mounted on top of a partition wall by means of brackets or by means of a groove formed in the planter itself, such that the planter straddles the top of the partition wall. The invention also includes a planter adapted to mount against a partition wall by means of brackets or by means of an extension of the planter designed to hook over the top of the partition wall.

Further details and embodiments of the present invention may be ascertained from the following description of the drawings and specification.

DESCRIPTION OF THE PREFERRED EMBODIMENTS

The planters of the present invention are designed to mount on top of or against a partition wall such as is normally found in modern offices.

Figure 13:
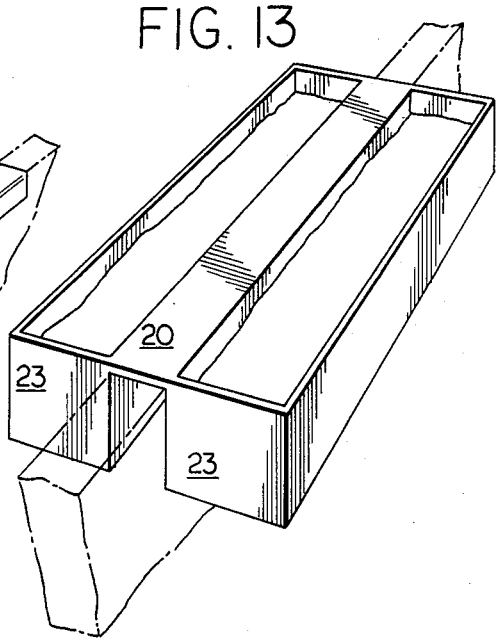
FIG. 13 shows a perspective view of a modification of the saddle bag planter illustrated in FIG. 12, wherein the portion joining the saddle bags is adjacent the top portion of the planters.
Figure 14:
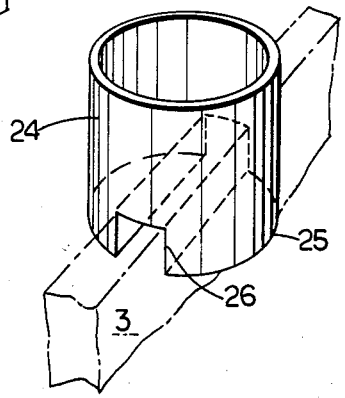
FIG. 14 shows a perspective view of a modification of the FIG. 9 device, wherein a round planter is shown.
Figure 15:
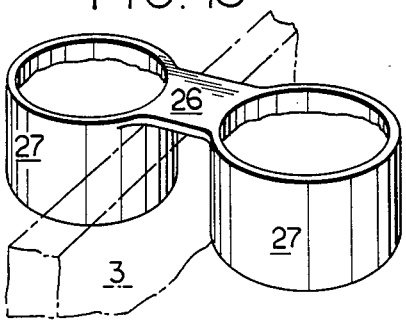
FIG. 15 shows a perspective view of a modification of FIG. 13 illustrating a pair of round saddle bag type planters.
Figure 16:
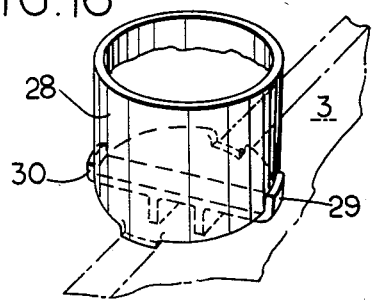
FIG. 16 shows a perspective view of a modification of the FIG. 1 device illustrating a round planter with a bracket similar to that illustrated in FIGS. 3 and 4.

The planters can be any shape, but the preferred shape is either rectangular, as shown in FIGS. 1, 2, 5, 6, 9–13, and 17–24 or round as shown in FIGS. 14–16. Generally, rectangular planters come in sizes which correspond to widths of wall partitions, for example, 18, 24 or 36 inches, or the planters may be slightly larger than the partition width as illustrated specifically in FIG. 5. The planters generally have an unobstructed interior for containing soil and plants, which retains any moisture.

Figure 8:
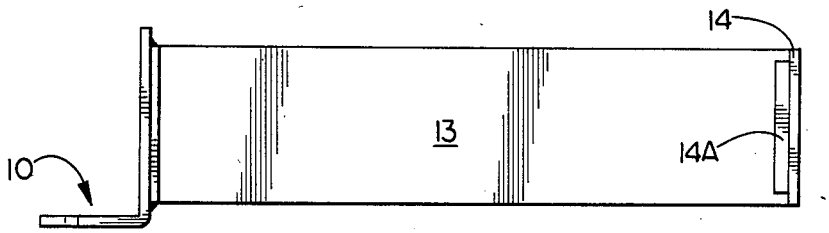
FIG. 8 shows a top view of the bracket of FIG. 7.
Figure 9:
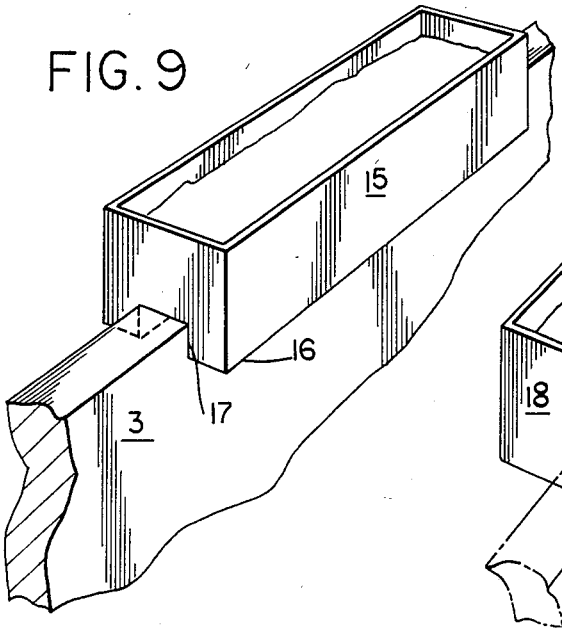
FIG. 9 shows a perspective view of a different embodiment of the present invention wherein the planter includes a groove in the bottom.
Figure 10:
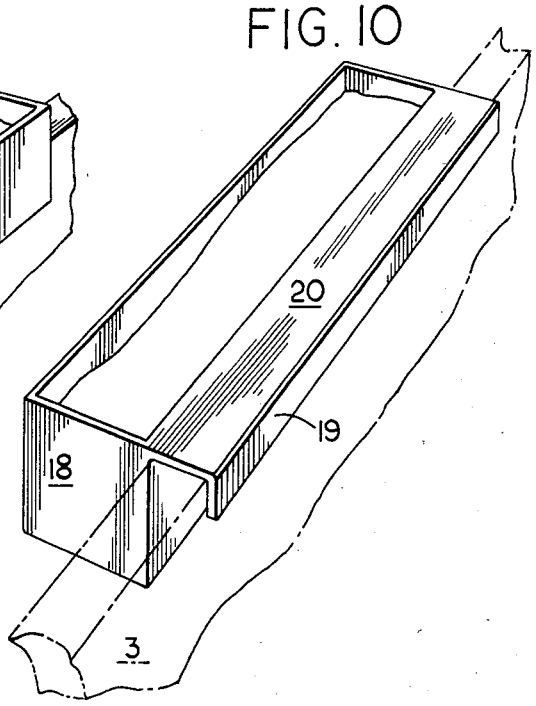
FIG. 10 shows a perspective view of a different embodiment wherein the planter includes an integral bracket at the top of the planter designed to loop over the top of the partition wall.
Figure 11:
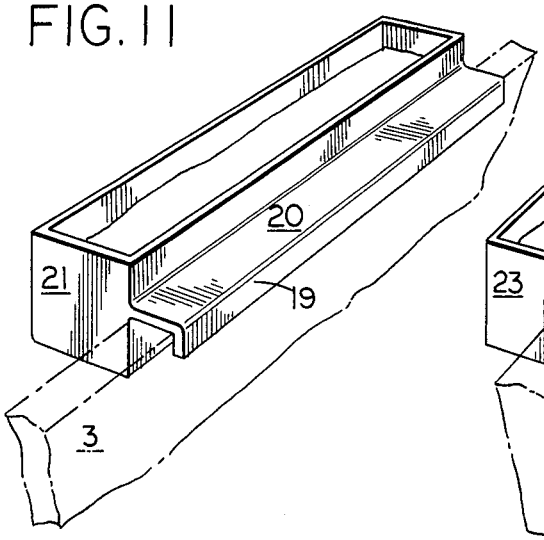
FIG. 11 shows a perspective view of another embodiment of the present invention wherein the planter includes an integral bracket near the middle of the planter designed to loop over the top of the partition wall.
Figure 12:
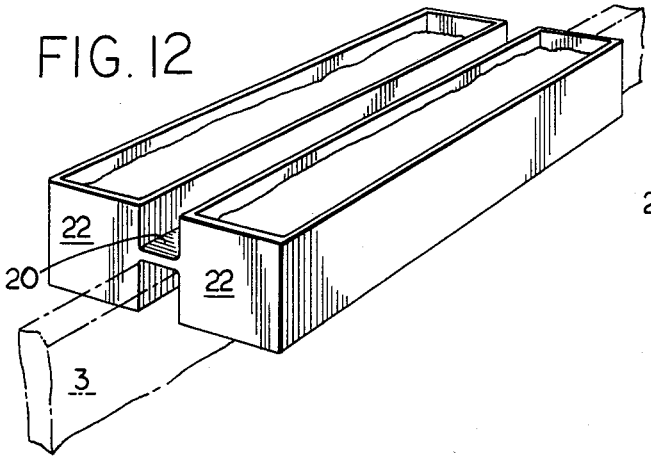
FIG. 12 shows a perspective view of another embodiment of the present invention illustrating a saddle bag type planter designed to fit over the top of a partition wall.

The planter can be supported by means of a bracket as illustrated in FIGS. 1–8 and 16–24, or the planter can be self supporting as illustrated in FIGS. 9–15. If the planter is supported by a bracket, the bracket design can be of the type made to fit on top of the partition wall as shown in FIGS. 1–4, and 17–24 or the type designed to mount between partition walls as shown in FIGS. 5–8. If the planter is self supporting, it can be provided with a groove on its bottom surface as shown in FIGS. 9 and 14, or it can be provided with an integral hook arm as illustrated in FIGS. 10 and 11, or it can be of the saddle bag type designed to straddle the top of a partition wall as shown in FIGS. 12, 13 and 15.

The planter may be made of any conventional material such as metal, plastic, synthetic resin or wood. If a metal is used to make the planter, preferably a non-oxidizing metal is employed like stainless steel, bronze, copper, aluminum or brass, with a brushed or satin texture being preferred. If plastic is employed to make the planter, plastics that can be molded or die cast are preferred. Suitable plastics may be employed such as ABS, acrylic, polystyrene, polyethylene, polyvinylchloride, polytetrafluoroethylene (teflon), polymethyl methacrylate (plexiglas or lucite), polypropylene, polycarbonate, or the like. Synthetic resins may also be employed to make the planter, such as nylon, rayon, dacron, formica, fiberglas, polyester, phenol formaldehyde, phenol-furfural, urea formaldehyde, and the like. Of course, the plastics can include color pigments, fire retardants, gloss agents, etc. as is well known to those skilled in the art. If wood is employed, preferably the wood is treated or coated, for example, with a plastic or paint, to prevent rot and retain moisture for the plants. Also a wood veneer, or a paper or fabric covering, could be employed on a planter which is made of metal, plastic, synthetic resin, or the like.

Figure 2:
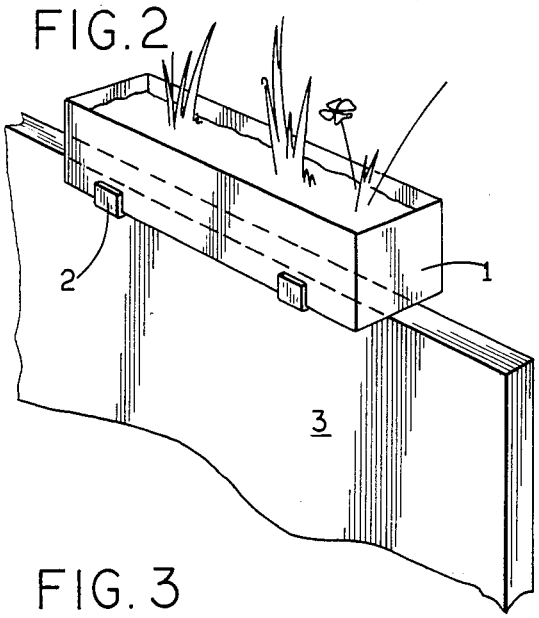
FIG. 2 shows a perspective view of the planter of FIG. 1 mounted atop a partition wall.
Figure 1:
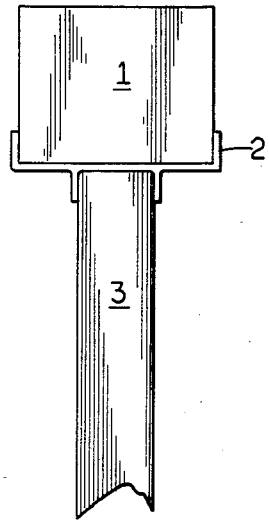
FIG. 1 shows an end view of a planter mounted on top of a partition wall by means of a bracket.

FIG. 1 shows an end view of a typical partition wall 3, with a support bracket 2 designed to fit on top of the partition wall 3, and a rectangular planter 1 supported by one or more brackets 2. FIG. 2 shows a perspective view of the rectangular planter 1 supported by two brackets.

Rather than the planter being rectangular as shown in FIG. 1, the planter could also be circular as illustrated in FIG. 16 by reference numeral 28. The support bracket 29 is similar to bracket 2, but has upwardly projecting end portions 30 which are round to conform to the shape of the circular planter 28.

The bracket may be the one-piece type or a two-piece slide type designed so that one size fits all. Because most partition walls are $1\frac{1}{2}''$ to 3" wide, the grips of the bracket which fit around the top wall are also designed for this width. The use of a slide type bracket eliminates the need of retaining many different size one-piece brackets. Generally, the brackets may be made of plastic, metal, resins, or the like, so long as the material is sufficient in strength to rigidly mount the planter.

Figure 3:
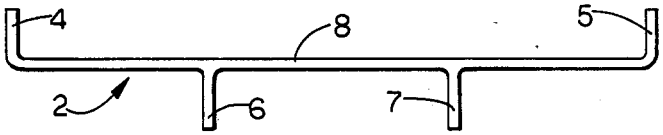
FIG. 3 shows a side view of the bracket illustrated in FIG. 1.
Figure 4:
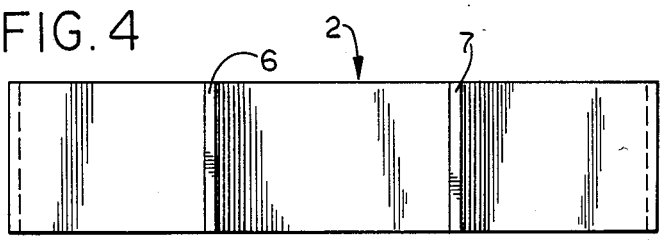
FIG. 4 shows a bottom view of the bracket illustrated in FIG. 1.

FIGS. 3 and 4 show bracket 2 which includes a base portion 8, with upwardly projecting end portions 4 and 5, spaced apart a sufficient distance to fit the width of rectangular planter 1. The bracket is tightly held upon the top width portion of the partition wall 3 by means of bottom grips 6 and 7. Grips 6 and 7 are integrally formed with the base portion 8 on the side opposite the side of the upwardly projecting end portions 4 and 5.

Figure 5:
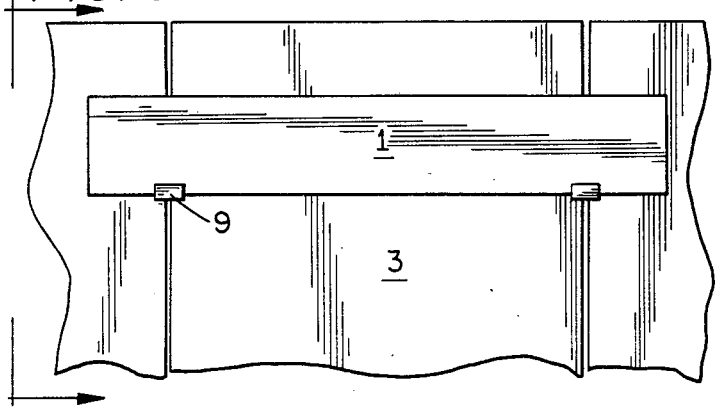
FIG. 5 shows a frontal view of a different embodiment of the invention wherein the planter is mounted against a partition wall by means of brackets.
Figure 6:
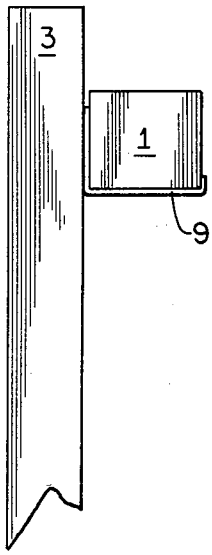
FIG. 6 shows a side view of the planter illustrated in FIG. 5.

The planter may be supported by brackets against the side of partition wall 3 as shown in FIGS. 5 and 6. The brackets 9 are made for insertion between the panels of the partition wall, and consequently, planter 1 must be about the same size as a panel, or preferably slightly longer than the width of a panel.

Figure 7:
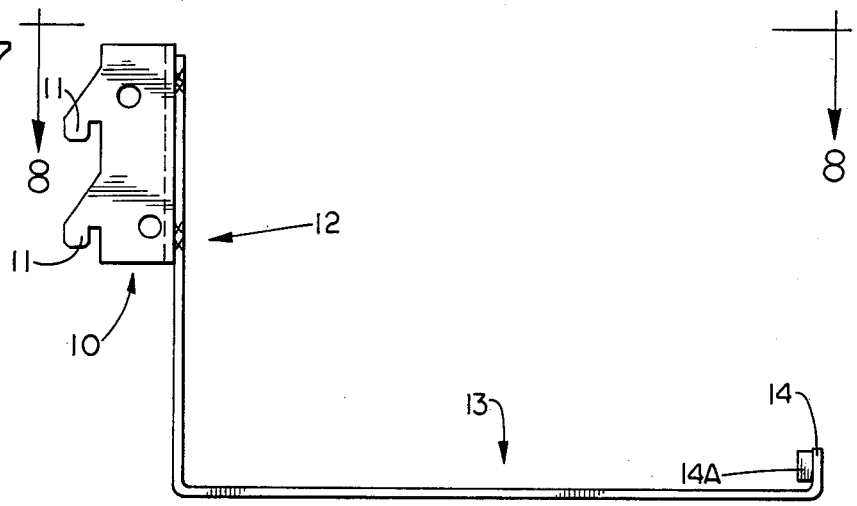
FIG. 7 shows an end view of the bracket partially illustrated in FIG. 6.

The bracket 9, as shown in FIGS. 7 and 8, comprises angle iron having an insert portion 10, and a perpendicular wall section 12. The inserted portion 10 includes some type of fastening means 11 which generally comprise one or more hook members. However, the fastening means 11 depend upon the type of wall partition employed. Typically, wall partitions are held together by means of quick threaded or double threaded screws to permit fast assembly and disassembly of the partition wall panels. Fastening means 11 is designed to hook on, or otherwise quickly attach to, the screws holding the wall partition together by placing the insert portion 10 between the panels of the wall partitions, so that fastening means 11 may be secured by the screws. The bracket 9 also includes a base member 13 designed to physically hold the planter, along with an upwardly projecting end portion 14 adapted to prevent planter 1 from sliding away from the partition wall 3 and sliding off bracket 9. End portions 14 may include a cushion or pad 14A to prevent scratching the planter.

Planter 15 illustrated in FIG. 9 straddles wall partition 3 and is self-supporting. The bottom wall 16 of planter 15 includes a grooved portion 17 which is of sufficient width and height to support the planter. The groved portion 17 produces a raised floor in the interior of the planter along with two longitudinal troughs. The troughs are designed to drain excess water away from the plants. This type of planter is preferably made of plastic because it can easily be manufactured by molding or die casting techniques.

FIG. 14 illustrates a planter 24 similar to that illustrated in FIG. 9, but is circular in shape. Bottom surface 25 including groove 26, is adapted to mate with the top portion of wall partition 3 to support the planter. The interior bottom surface of planter 24 produces a raised floor with corresponding troughs as described with respect to FIG. 9.

The planter need not be positioned immediately above the top of the partition wall, but may be offset as shown in FIGS. 10–13 and 15. A single rectangular planter 18 and 21 is illustrated in FIGS. 10 and 11, respectively. Each planter is supported by a horizontal arm 20 with a perpendicular downwardly projecting component 19. Horizontal arm 20 is attached to planter 18 at the top lip of the planter as shown in FIG. 10.

Horizontal arm 20 is attached to planter 21 approximately midway along the back side wall of the planter such that the planter projects substantially above the top of the partition wall.

FIGS. 12, 13 and 15 illustrate a saddle bag type arrangement where two planters tightly straddle the top of the partition wall. As illustrated in FIGS. 12 and 13, two planters 22 and 23, respectively, are integrally connected with a horizontal arm 20. FIG. 12 shows horizontal arm 20 connecting the pair of planters 22 midway along the longitudinal wall of each planter which bears directly against partition wall 3. In this manner, planters 22 project substantially above the top of the partition wall. FIG. 13 shows horizontal arm 20 connecting planters 23 adjacent the lip of each planter. This arrangement maintains a profile approximately the height of the partition wall.

FIG. 15 is similar to the planter shown in FIG. 13, except that the planters 27 are round and integrally attached by a horizontal segment 26. The segment 26 is attached adjacent the lip of planters 27 as disclosed with respect to the planters 23 illustrated in FIG. 13.

Figure 17:
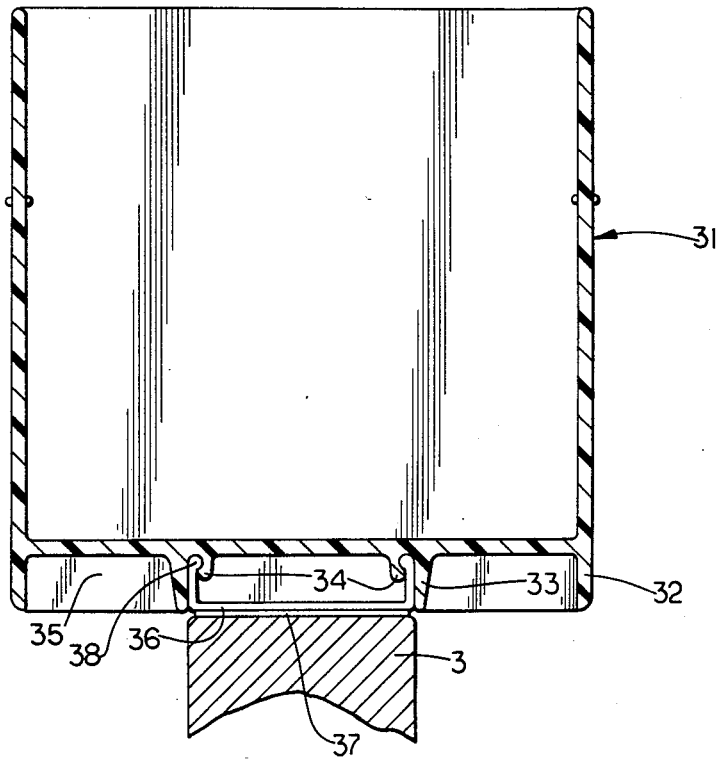
FIG. 17 shows a cross-sectional end view of another embodiment of the present invention illustrating a planter mounted atop a partition wall by means of a slide bracket.
Figure 18:
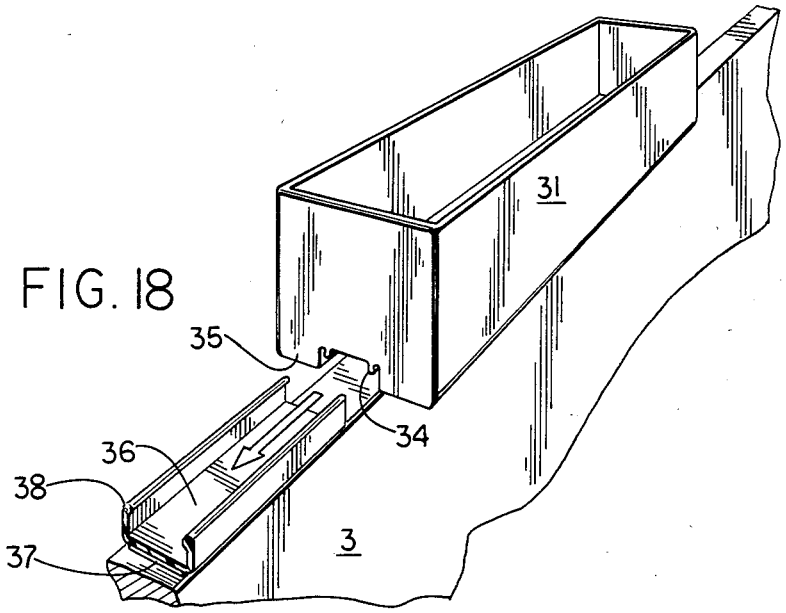
FIG. 18 shows a perspective view of the planter of FIG. 17 as it disengages the slide bracket.

FIGS. 17 and 18 illustrate a slide system for supporting planter 31 atop wall partition 3. Planter 31 has two longitudinal slide grooves projecting downwardly from the bottom, underneath side of the planter. Each slide groove is formed from a pair of downwardly projecting arms 33 and 34. Arm 33 is generally longer than arm 34 and arm 34 generally terminates in a bulbous edge.

Slide bracket 36 is firmly attached atop wall partition 3 by means of adhesive tape 37, or the like. Slide bracket 36 includes upwardly projecting side walls 38, both of which terminate in a bulbous edge portion, each edge portion directed toward the other.

Longitudinal skirt 32 and width skirt 35 serve to cover the slide bracket arrangement for aesthetic purposes. Once the slide bracket is firmly mounted to the wall partition, planter 31 is manipulated to slide into and over slide bracket 36, as shown in FIG. 18, until the planter is approximately centered on the slide bracket. In this manner the planter is now ready to be employed.

Figure 19:
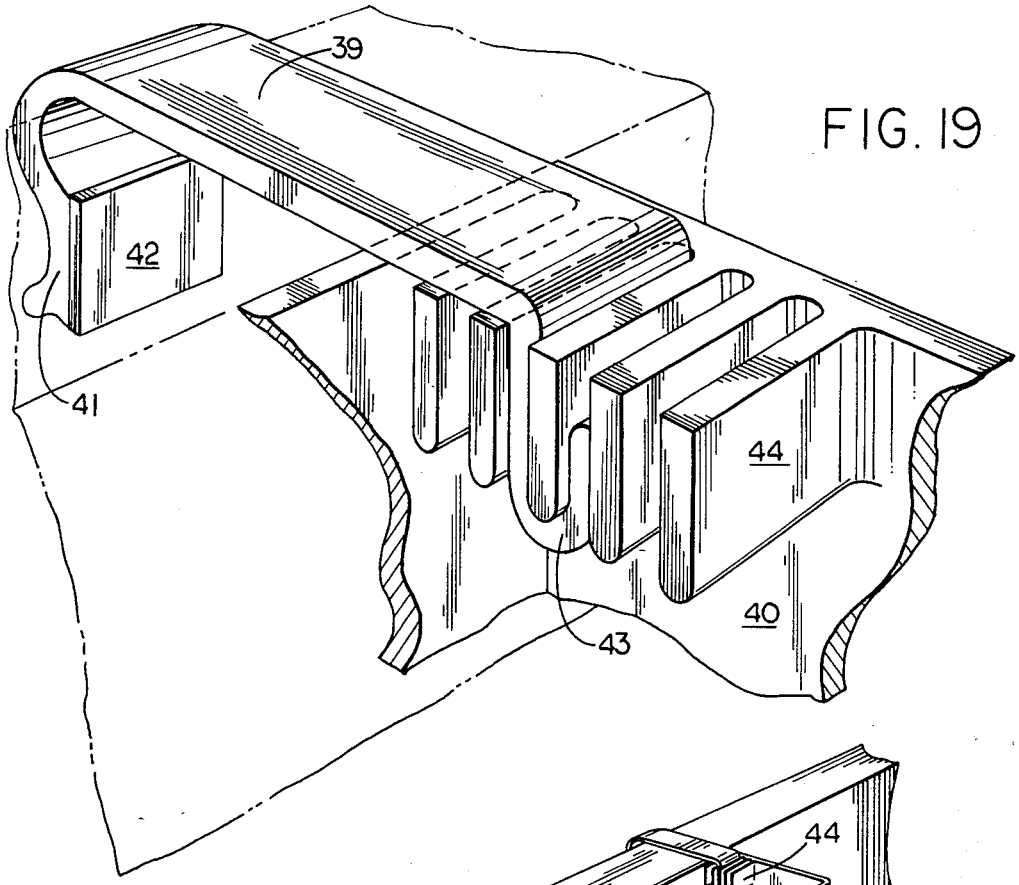
FIG. 19 shows an exploded perspective view of yet another modification of the present invention illustrating a top mounted spring clip supporting a side mounted planter.
Figure 20:
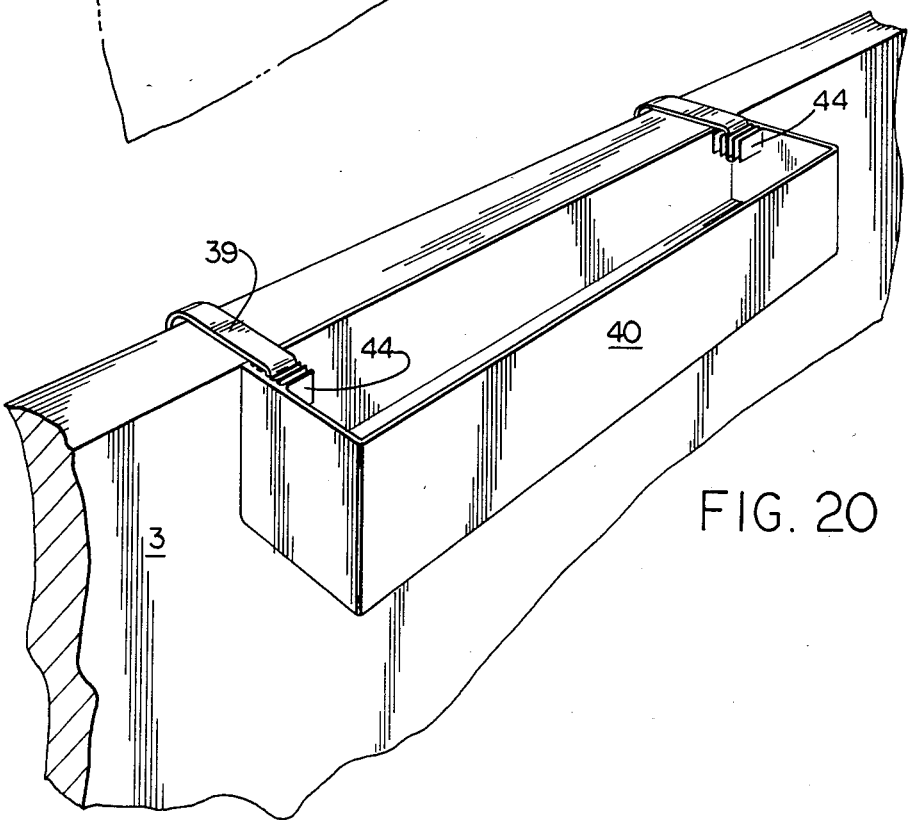
FIG. 20 shows a perspective view of the spring clip and planter of FIG. 19.

Another modification of the present invention is illustrated by FIGS. 19 and 20. As illustrated, planter 40 includes a series of ears 44 projecting inwardly from each end wall of the planter. Each ear is spaced apart a distance slightly greater than the thickness of spring clip 39.

Spring clip 39 includes a flexible curved lateral end 41 and a lateral U-shaped hook end 43. As shown in the exploded view of FIG. 19, spring clip 39 is placed over the top of wall partition 3 such that lateral end 41 is pressed tightly against the side of wall partition 3. Next, planter 40 is held adjacent the top portion of wall partition 3, permitting spring clip 39 to project into the interior of the planter. Then the spring clip 39 is moved toward an end wall of the planter such that U-shaped hook 43 engages an ear 44. This arrangement permits the planter 40 to accomodate many different thicknesses of wall partitions.

In order to prevent scratching the wall partion, curved lateral end 41 may include a cushion 42, which also contributes to the resiliency of spring clip 39, insofar as its ability to accomodate many different thicknesses of wall partitions.

A preferred method of mounting a planter atop a partition wall 3 is illustrated by FIGS. 21–24. This method is preferred for top mounting because the brackets fit most all the common thicknesses of wall partitions and because this system permits mounting the planter adjacent a wall of the building, when the wall partition is mounted adjacent the wall of the building.

Planter 45 includes a circumferential skirt 46 to hide the mounting system for aesthetic purposes. The planter also includes a raised floor 47, which permits drainage in troughs 48, just as incorporated with the FIGS. 9 and 14 planters. The interior side wall of planter 45 includes a tapered wall 49 which terminates into troughs 48. The tapered wall 49 and circumferential skirt 46 create a longitudinal slot beneath the bottom of the planter for upwardly projecting member 50.

Figure 22:
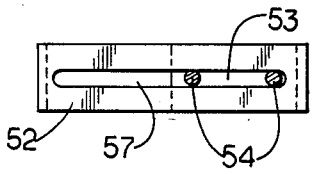
FIG. 22 shows a plan view of the two piece clamp brackets illustrated in FIG. 21.
Figure 23:
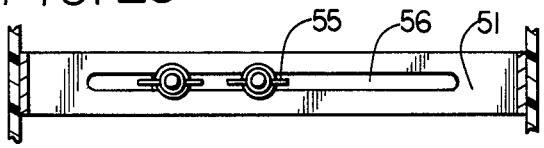
FIG. 23 shows a plan view of the three piece bracket illustrated in FIG. 21.
Figure 24:
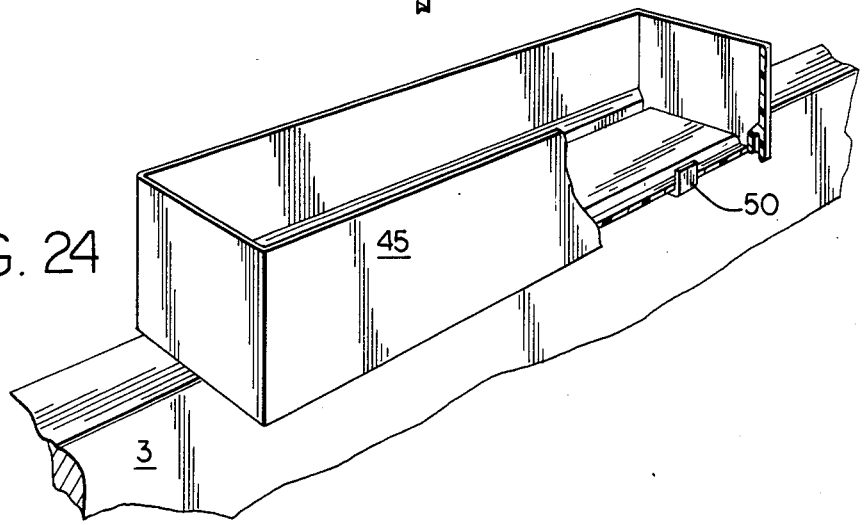
FIG. 24 shows a cut-away perspective view of the planter of FIG. 21 mounted upon partition wall 3.

The mounting system comprises two L-shaped brackets 52 and 53. One or more threaded studs 54 are securely and integrally fastened to bracket 53. The studs 54 may be welded, glued, press fitted, or the like onto bracket 53. Bracket 52 is much longer than bracket 53 and has a longitudinal slot 57 as illustrated in FIG. 22. A planter bracket 51 includes a longitudinal slot 56 with an upwardly projecting member 50 at each end, which fit into corresponding longitudinal slots formed by the planter as previously explained.

Figure 21:
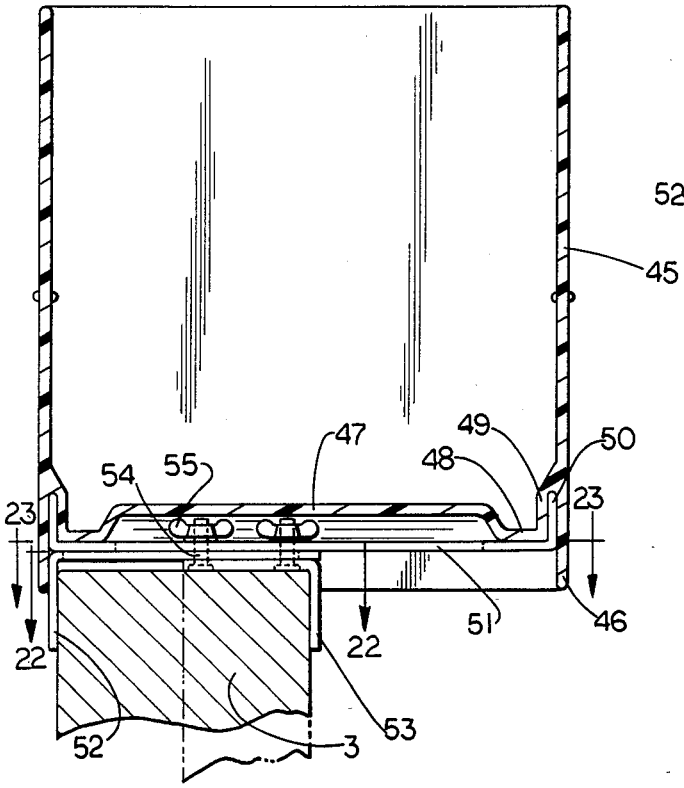
FIG. 21 shows a cross-sectional end view of another embodiment of the present invention illustrating a three piece bracket and a corresponding planter.

The L-shaped brackets 52 and 53 are placed atop wall partition 3 and are adjustable to fit walls $1\frac{1}{2}$ to 3" thick. The wall illustrated in FIG. 21 represents a 3" thick wall 3. If the wall were $1\frac{1}{2}$" thick, bracket 52, would extend beyond the vertical portion of bracket 53, as shown in FIG. 21, but would not extend to circumferential skirt 46.

Once the L-shaped brackets are positioned atop wall partition 3 and adjusted to the wall thickness, planter bracket 51 is placed over the top L-shaped bracket 52 such that studs 54 extend through slot 57 of bracket 52, and extend through slot 56 of planter bracket 51. If the planter is to be offset on wall partition 3, such as shown in FIG. 21, so that the planter may be mounted atop the partition wall but adjacent a wall of the building, the planter bracket is positioned such that one end is flush with the vertical end of bracket 52, and the other end projects out beyond wall partition 3. Once wing nuts 55 are tightened to securely fasten the bracket mounting system, planter 45 is positioned over and forced downwardly on planter bracket 51 until member 50 of the planter bracket is fully inserted in the longitudinal slot of the planter. With this type of mounting system the position of the planter over the wall partition may vary as desired.

Optionally the bracket system could include a fourth bracket, which would be a mere flat plate. This fourth bracket would include the studs 54, and it would be positioned on top of the upper surface of wall partition 3. Since the fourth bracket includes the studs, bracket 53 will not include studs, but will merely have a longitudinal slot like bracket 52. This system is not as desirable because the fourth bracket is expendable and unnecessary.

Of course, the different embodiments may be varied with obvious substitutions, replacements or modifications without destroying the scope of the present invention.

What is claimed is:

1. A planter designed to be mounted upon a wall partition having horizontal surface terminating in two parallel vertical surfaces comprising:

a leakproof container having a side wall and a bottom, and an unobstructed open interior, said container including two longitudinal slots formed in said bottom of said container; and a bracket means including means capable of being in friction contact with each of said two vertical surfaces to securely attach said bracket means to said wall partition, and means to securely attach said container to said bracket including a planter bracket having a base portion and upwardly projecting end portions extending from said base portion, whereby said container, is supported by said upwardly projecting end portions which friction fit within said longitudinal slots thereby positioning said container above and in close proximity to said horizontal surface.

2. The planter of claim 1, wherein said means to securely fasten said bracket means to said wall partition includes two L-shaped brackets.

3. The planter of claim 2, wherein said two L-shaped brackets include a short bracket with one or more studs and a long bracket with a longitudinal slot, wherein said two L-shaped brackets are held together by wing nuts.

4. The planter of claim 3, wherein said bracket means includes means to securely fasten together said L-shaped brackets and said base portion.

5. The planter of claim 1, wherein said container includes a skirt integrally formed with said side wall which projects below said bottom of said container so as to cover up said bracket means when said planter is mounted upon a wall partition.

6. The planter of claim 1, wherein said bottom has a raised portion so as to provide spaced for at least a part of said bracket means.

7. The planter of claim 6, wherein said raised portion of said bottom is sandwiched between said longitudinal troughs in said bottom for draining away excessive water.

8. The planter of claim 1, wherein said bracket means includes one bracket adapted to be positioned at each end of said container.

9. A planter designed to be mounted upon a wall partition of the type having a horizontal surface terminating in two parallel vertical surfaces comprising:

a leak-proof container having a side wall and a bottom, and an unobstructed interior, said bottom having two longitudinal slots therein; and a bracket means comprising a pair of angle iron members each having a horizontal leg and a downwardly depending leg, said downwardly depending legs being in parallel, spaced apart, opposed relationship, and each being located adjacent one of said wall partition vertical surfaces, means in association with said horizontal legs for varying said space between said downwardly depending legs to render said legs abutable with their respective wall partition vertical surfaces, and means to attach said container to said horizontal legs, said means including a planter bracket having a base portion and upwardly projecting end portions extending from said base portion wherein said upwardly projecting end portions friction fit within said longitudinal slots.

10. A planter designed to be mounted upon a wall partition having a horizontal surface terminating in two parallel vertical surfaces comprising:

a leak-proof container having a side wall and a bottom, and an unobstructed open interior, said bottom having two longitudinal slots therein, said container having downwardly depending means in association with said bottom in parallel, spaced, opposed relationship to each other and each being located adjacent one of said vertical surfaces, and means to adjust said space between said downwardly depending means to render each abutable with its respective one of said vertical surfaces, said downwardly depending means also including upwardly projecting end portions, said upwardly projecting end portion being friction fit within said longitudinal slots.

11. The planter of claim 10, wherein said downwardly depending means is shiftable transversely of said container between a position wherein one of said downwardly depending means is adjacent one edge of said bottom of said container, and a position wherein the other of said downwardly depending means is adjacent the opposite edge of said bottom of said container.

12. The planter of claim 10, wherein said downwardly depending means comprises a pair of angle iron members, each having a horizontal leg and a downwardly depending leg, said downwardly depending legs being in parallel, spaced-apart, opposed relationship, and each being located adjacent one of said vertical surfaces, means in association with said horizontal legs for varying said space between said downwardly depending legs to render said legs abutable with their respective vertical surfaces, said upwardly projecting end portions having means to attach said upwardly projecting end portions to said horizontal legs.

* * * * *